US011261058B2

(12) United States Patent
Yan et al.

(10) Patent No.: US 11,261,058 B2
(45) Date of Patent: Mar. 1, 2022

(54) TRAVELLING CABLE SUPPORT ARRANGEMENT OF AN ELEVATOR

(71) Applicant: Kone Corporation, Helsinki (FI)

(72) Inventors: Zhizhong Yan, Helsinki (FI); Antti I. Maki, Helsinki (FI); Jaakko Kalliomaki, Helsinki (FI); Takeshi Ogata, Helsinki (FI)

(73) Assignee: Kone Corporation, Helsinki (FI)

( * ) Notice: Subject to any disclaimer, the term of this patent is extended or adjusted under 35 U.S.C. 154(b) by 350 days.

(21) Appl. No.: 16/446,810

(22) Filed: Jun. 20, 2019

(65) Prior Publication Data

US 2020/0079622 A1 Mar. 12, 2020

(30) Foreign Application Priority Data

Sep. 12, 2018 (EP) ..... 18194002

(51) Int. Cl.
*B66B 7/06* (2006.01)
*B66B 15/02* (2006.01)

(52) U.S. Cl.
CPC ..... *B66B 7/064* (2013.01); *B66B 15/02* (2013.01)

(58) Field of Classification Search
CPC ..... B66B 7/064; B66B 15/02; B66B 7/046; B66B 7/048
See application file for complete search history.

(56) References Cited

U.S. PATENT DOCUMENTS 3,087,583 A * 4/1963 Bruns ..... B66B 7/048 187/406
3,882,968 A * 5/1975 Suozzo ..... B66B 7/068 187/264
4,716,989 A * 1/1988 Coleman ..... B66B 7/068 187/404
5,861,084 A * 1/1999 Barker ..... B66B 7/10 187/264

(Continued)

FOREIGN PATENT DOCUMENTS

JP H05178564 A 7/1993
JP H06278968 A 10/1994

(Continued)

OTHER PUBLICATIONS

European Search Report for European Patent Application No. 18194002 dated Mar. 7, 2019.

*Primary Examiner* — Michael A Riegelman
(74) *Attorney, Agent, or Firm* — Harness, Dickey & Pierce, P.L.C.

(57) ABSTRACT

The arrangement comprises at least one travelling cable, a guide rail extending from a pit floor at least to a middle of an elevator shaft, an intermediate fixing point positioned in connection with the guide rail, the at least one travelling cable being fixedly attached in said intermediate fixing point, a travelling cable keeper being movably supported on the guide rail so that the travelling cable keeper is movable upwards and downwards along the guide rail, the at least one travelling cable being movably supported in support points on the travelling cable keeper, a path of the at least one travelling cable through the support points in the travelling cable keeper being curved, the at least one travelling cable being movable through the support points.

18 Claims, 6 Drawing Sheets

(56) References Cited

U.S. PATENT DOCUMENTS

Figure 1:
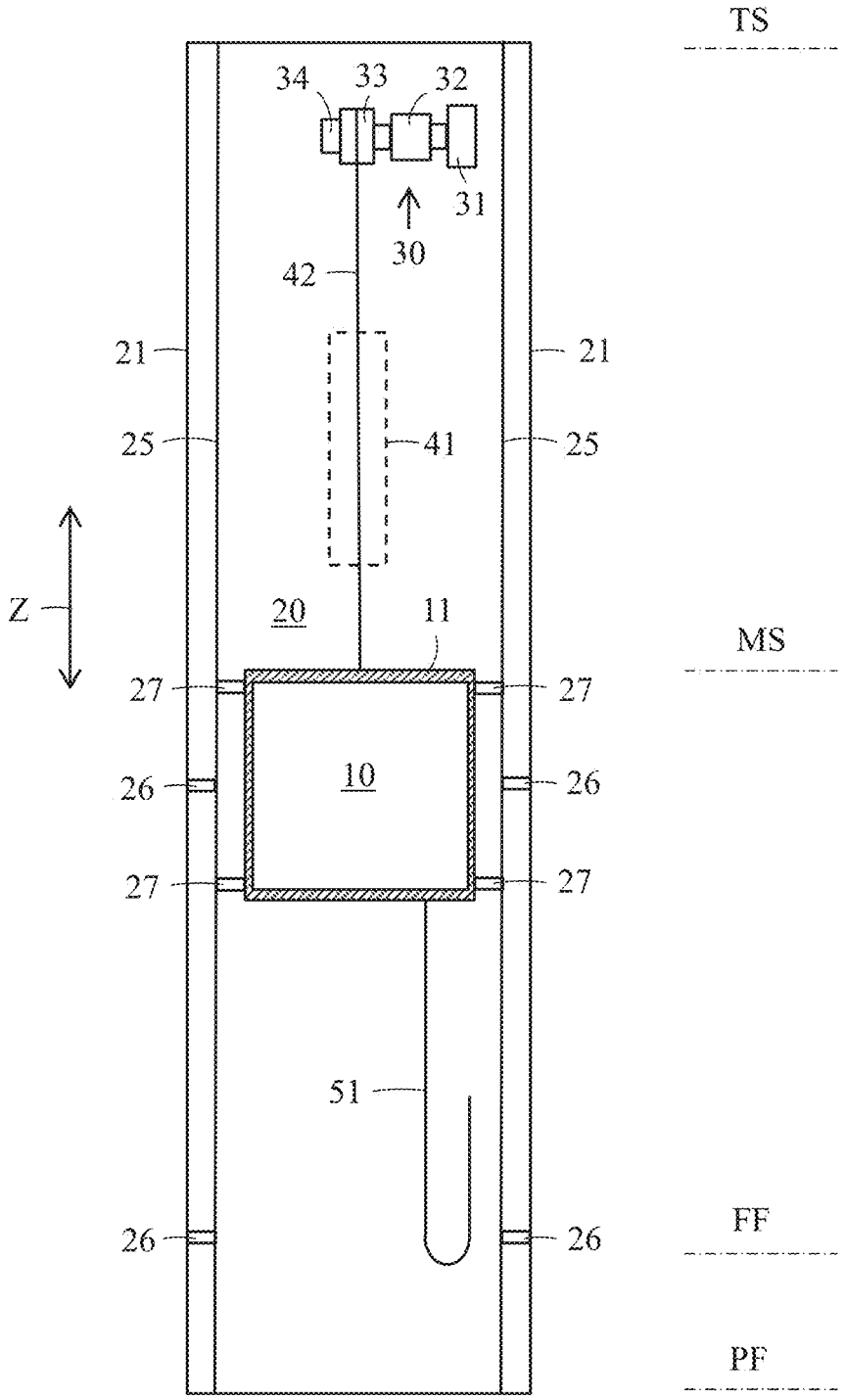

| | | | | |
|---|---|---|---|---|
| 6,488,125 | B1 * | 12/2002 | Otsuka | B66B 7/068 187/264 |
| 7,610,994 | B2 * | 11/2009 | Green | B66B 7/068 187/251 |
| 9,878,879 | B2 * | 1/2018 | Kim | B66B 5/22 |
| 10,266,372 | B2 * | 4/2019 | Fauconnet | G01M 5/0025 |
| 2005/0133312 | A1 * | 6/2005 | Kaczmarek | B66B 7/068 187/266 |
| 2013/0020150 | A1 * | 1/2013 | Ropponen | B66B 7/06 187/414 |
| 2014/0224590 | A1 * | 8/2014 | Puranen | B66B 5/02 187/247 |
| 2018/0009635 | A1 * | 1/2018 | Fauconnet | B66B 5/005 |
| 2018/0029830 | A1 * | 2/2018 | Martins | B66B 11/0025 |
| 2020/0079622 | A1 * | 3/2020 | Yan | B66B 7/06 |

FOREIGN PATENT DOCUMENTS

| | | | |
|---|---|---|---|
| JP | 2003182954 | A | 7/2003 |
| JP | 2010083619 | A | 4/2010 |

* cited by examiner

TRAVELLING CABLE SUPPORT ARRANGEMENT OF AN ELEVATOR

RELATED APPLICATIONS

This application claims priority to European Patent Application No. 18194002.4 filed on Sep. 12, 2018, the entire contents of which are incorporated herein by reference.

FIELD

The invention relates to a travelling cable support arrangement of an elevator.

BACKGROUND

An elevator may comprise a car, a shaft, lifting machinery, ropes, and a counterweight. A separate or an integrated car frame may surround the car.

The lifting machinery may be positioned in the shaft. The lifting machinery may comprise a drive, an electric motor, a traction sheave, and a machinery brake. The lifting machinery may move the car upwards and downwards in the shaft. The machinery brake may stop the rotation of the traction sheave and thereby the movement of the elevator car.

The car frame may be connected by the ropes via the traction sheave to the counterweight. The car frame may further be supported with gliding means at guide rails extending in the vertical direction in the shaft. The guide rails may be attached with fastening brackets to the side wall structures in the shaft. The gliding means keep the car in position in the horizontal plane when the car moves upwards and downwards in the shaft. The counterweight may be supported in a corresponding way on guide rails that are attached to the wall structure of the shaft.

The car may transport people and/or goods between the landings in the building. The walls in the shaft may be formed as solid walls and/or as an open steel structure.

Travelling cables pass from the car to a top of the shaft. The travelling cables connect the controller in the car with the main controller of the elevator. The flexible and long hanging travelling cables in the shaft are very susceptible to swaying.

In high rise elevators, the travelling cables may sway together with the shaft and building due to strong winds or storms. Even moderate winds may cause notable travelling cable sways in high rise elevators built in slender buildings.

In marine elevators, the travelling cables may sway along with the ship due to the waves of the sea.

In elevators used in seismic zones, the travelling cables may sway along with the seismic waves.

Swaying travelling cables may collide with other elevator components in the shaft, whereby the other elevator component and/or the travelling cable itself might become damaged. Swaying travelling cables might get stuck to shaft mechanics. Collisions caused by swaying travelling cables in the shaft may generate noise in the shaft. The ride comfort of the elevator may be reduced due to car shaking caused by the forces of swaying travelling cables acting on the car sling. Especially when the natural frequency of the building and the swaying travelling cables overlap in some elevator car positions, the amplitude of the travelling cable sway will be greatly increased.

There is thus a need to eliminate this swaying of the travelling cables. Prior art arrangement for eliminating the swaying of travelling cables of an elevator are not satisfactory.

SUMMARY

An object of the present invention is to present an improved travelling cable support arrangement of an elevator.

The travelling cable support arrangement of an elevator is defined in claim 1.

The travelling cable support arrangement of an elevator comprises:

at least one travelling cable, a guide rail extending from a pit floor at least to a middle of an elevator shaft, an intermediate fixing point positioned in connection with the guide rail, the at least one travelling cable being fixedly attached in said intermediate fixing point, a travelling cable keeper being movably supported on the guide rail so that the travelling cable keeper is movable upwards and downwards along the guide rail, the at least one travelling cable being movably supported in support points on the travelling cable keeper, a path of the at least one travelling cable through the support points in the travelling cable keeper being curved, the at least one travelling cable being movable through the support points.

The travelling cable support arrangement prevents swaying of the at least one travelling cable in an efficient manner.

The travelling cable support arrangement may be used in any kind of elevators. The travelling cable support arrangement is, however, especially useful in high-rise elevators, in marine elevators, and in elevators used in seismic zones.

The invention may be used in connection with a new elevator installation and in connection with a renovation of an elevator.

The travelling cable support arrangement according to the invention may be used in connection with only one travelling cable.

The travelling cable support arrangement according to the invention may on the other hand be used in connection with at least two travelling cables i.e. in connection with several travelling cables.

The paths of the at least two travelling cables through the travelling cable support arrangement may be nested or concentric.

DRAWINGS

Figure 2:
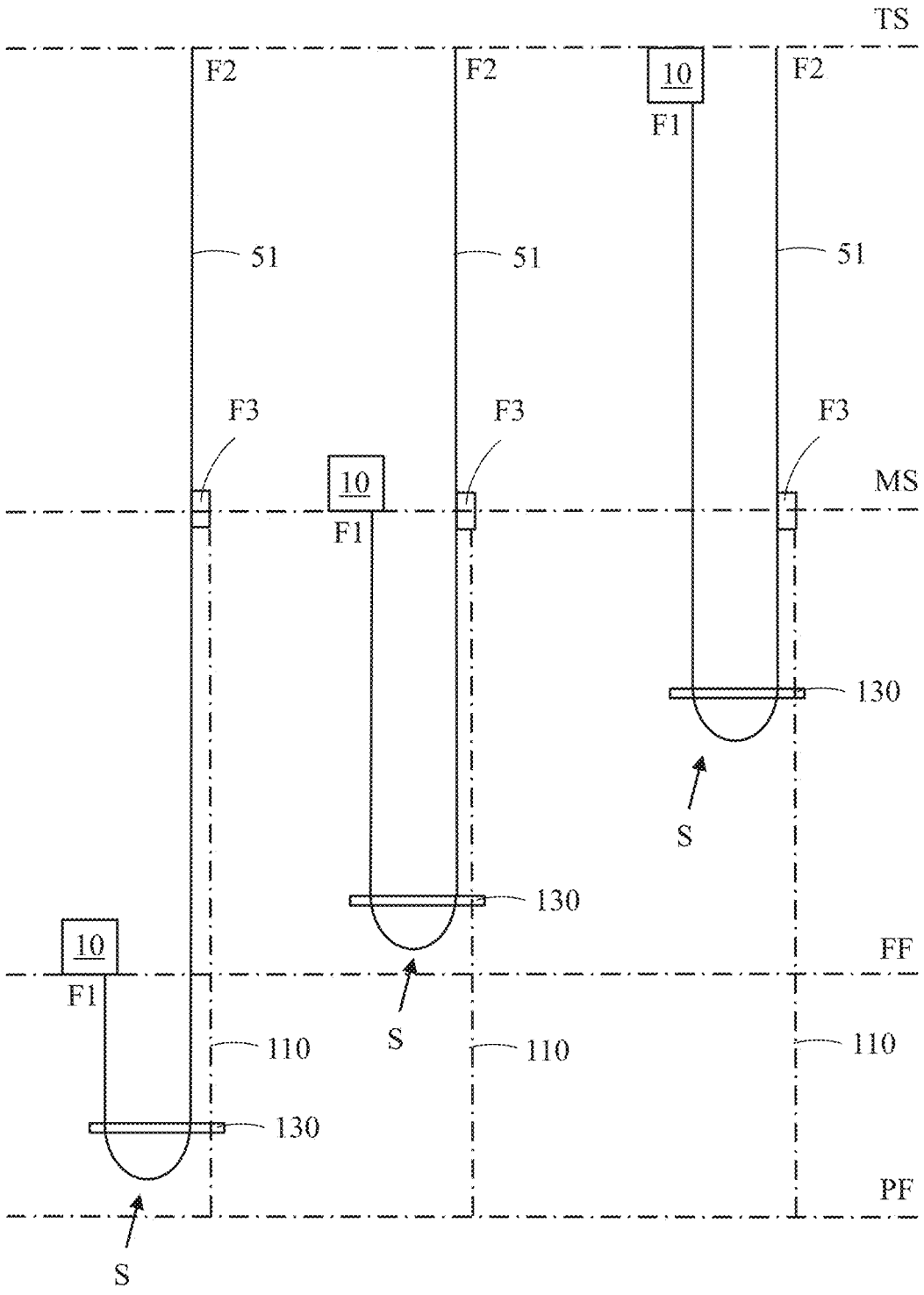
Figure 3:
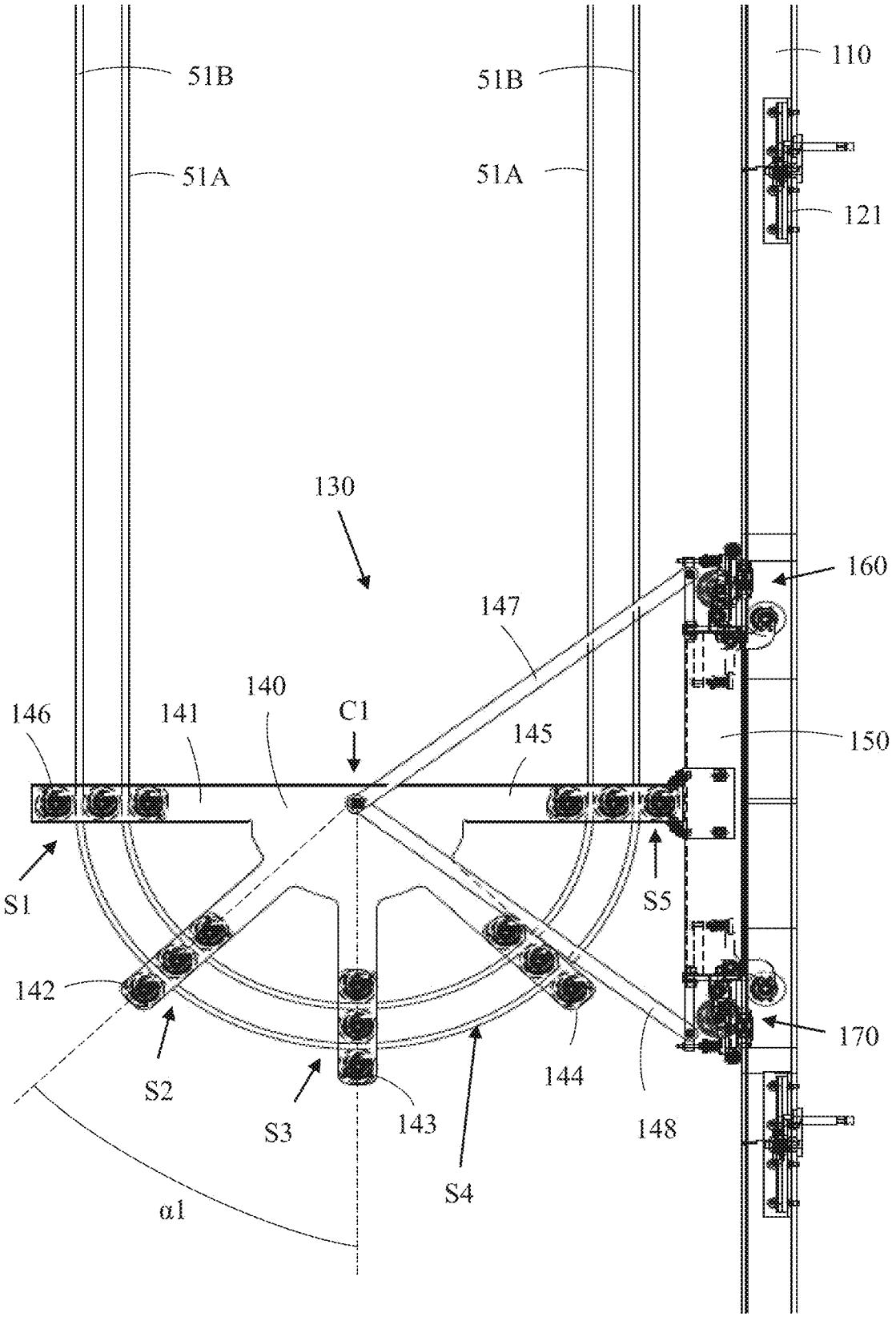
Figure 4:
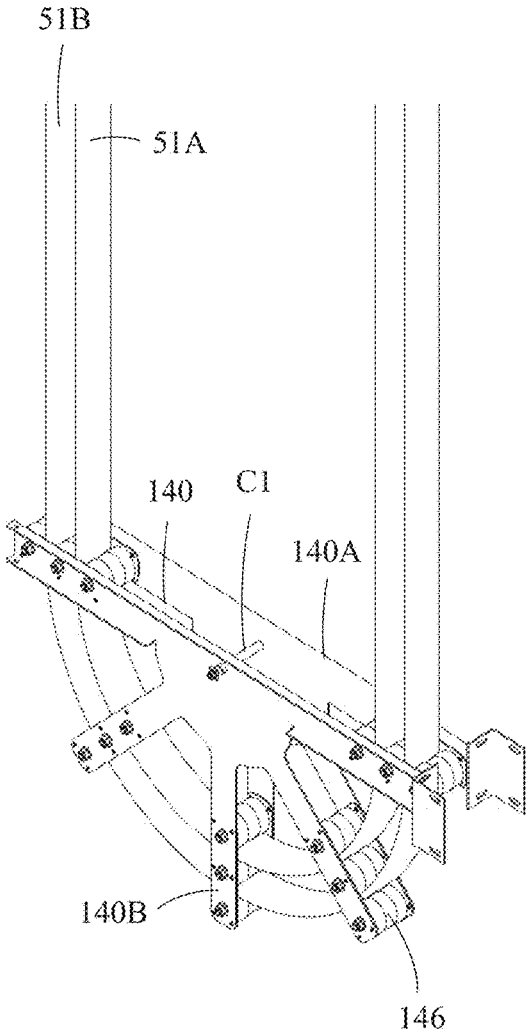
Figure 5:
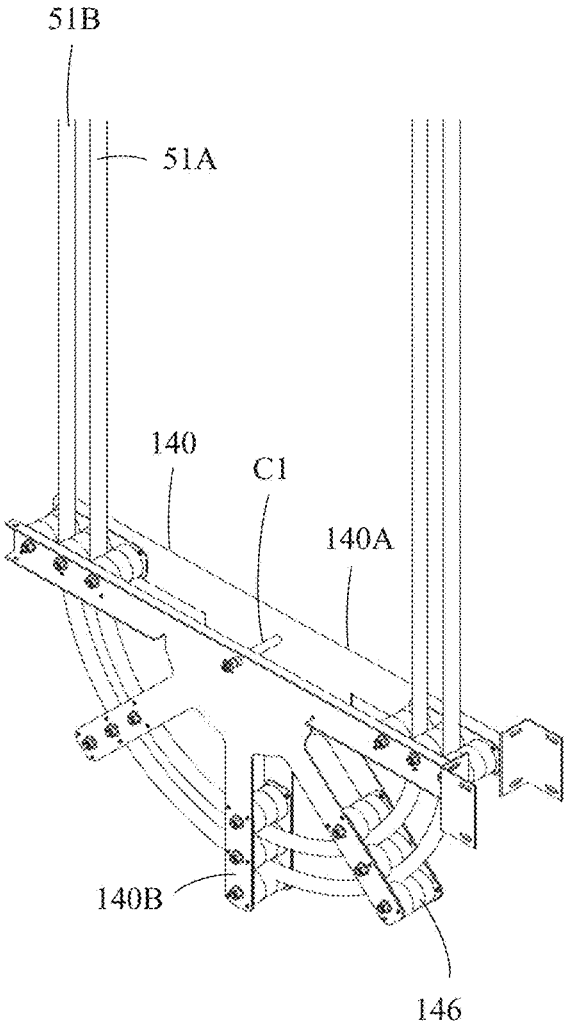
Figure 6:
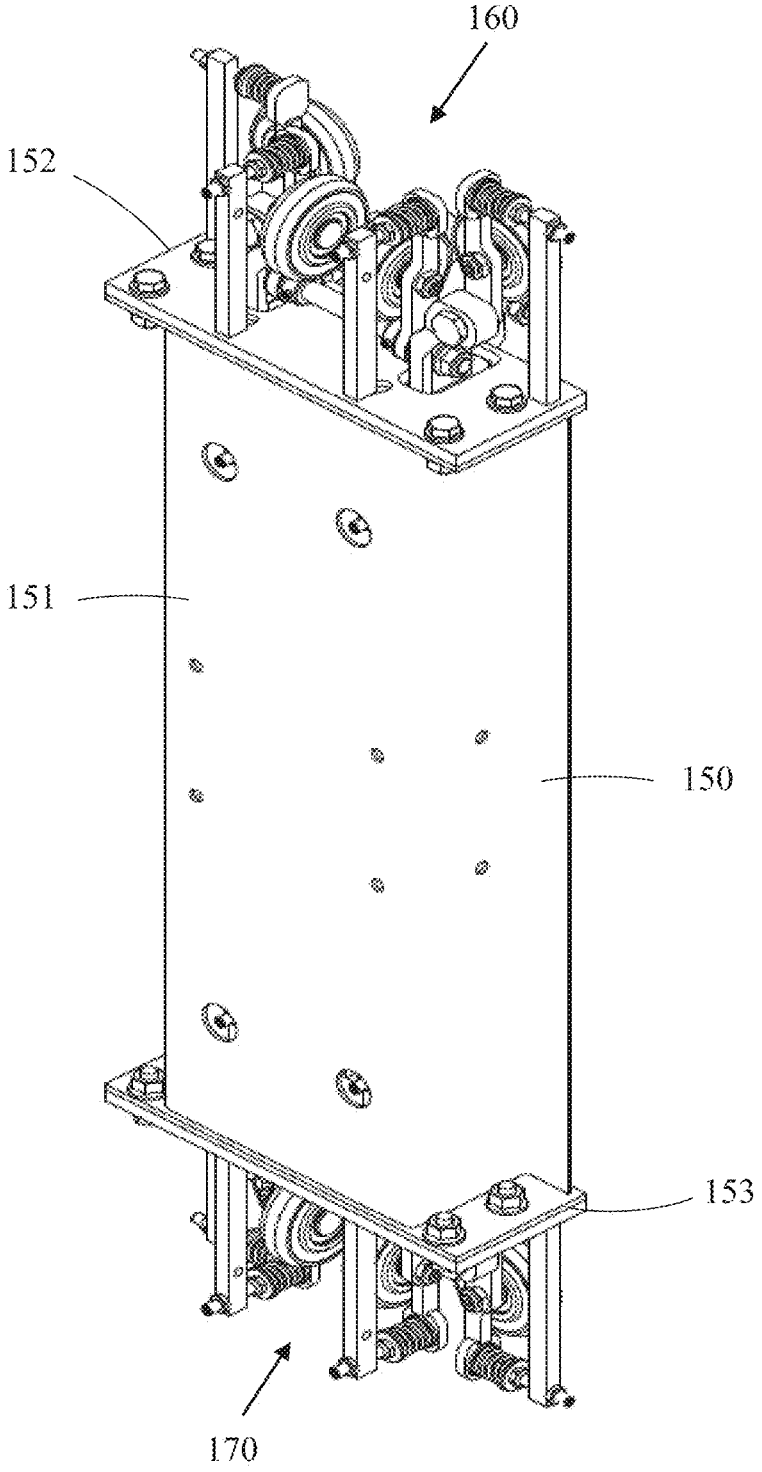
Figure 7:
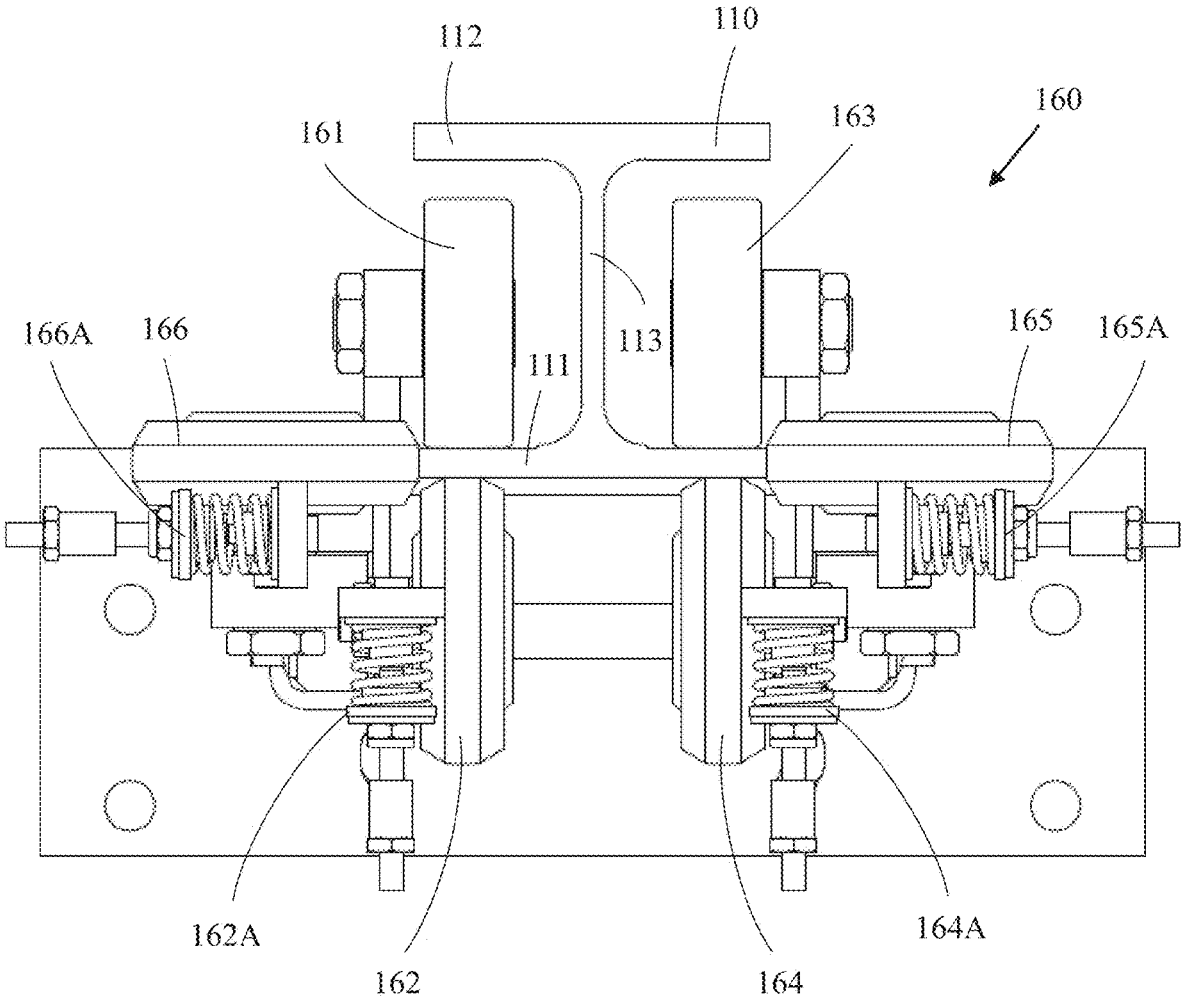

The invention will in the following be described in greater detail by means of preferred embodiments with reference to the attached drawings, in which:

FIG. 1 shows a side view of an elevator,

FIG. 2 shows the working principle of a travelling cable support arrangement of an elevator, FIG. 3 shows a side view of a travelling cable support arrangement of an elevator, FIG. 4 shows a frame of a travelling cable keeper for flat cables, FIG. 5 shows a frame of a travelling cable keeper for round cables, FIG. 6 shows a support part of a travelling cable keeper, FIG. 7 shows roller equipment for the support part in the travelling cable keeper.

DETAILED DESCRIPTION

FIG. 1 shows a side view of an elevator.

The elevator may comprise a car 10, an elevator shaft 20, lifting machinery 30, ropes 42, and a counterweight 41. A separate or an integrated car frame 11 may surround the car 10.

The lifting machinery 30 may be positioned in the shaft 20. The lifting machinery 30 may comprise a drive 31, an electric motor 32, a traction sheave 33, and a machinery brake 34. The lifting machinery 30 may move the car 10 in a vertical direction Z upwards and downwards in the vertically extending elevator shaft 20. The machinery brake 34 may stop the rotation of the traction sheave 33 and thereby the movement of the elevator car 10.

The car frame 11 may be connected by the ropes 42 via the traction sheave 33 to the counterweight 41. The car frame 11 may further be supported with gliding means 27 on guide rails 25 extending in the vertical direction in the shaft 20. The gliding means 27 may comprise rolls rolling on the guide rails 25 or gliding shoes gliding on the guide rails 25 when the car 10 is moving upwards and downwards in the elevator shaft 20. The guide rails 25 may be attached with fastening brackets 26 to the side wall structures 21 in the elevator shaft 20. The gliding means 27 keep the car 10 in position in the horizontal plane when the car 10 moves upwards and downwards in the elevator shaft 20. The counterweight 41 may be supported in a corresponding way on guide rails that are attached to the wall structure 21 of the shaft 20.

The car 10 may transport people and/or goods between the landings in the building. The walls 21 in the elevator shaft 20 may be formed of solid walls and/or of an open steel structure.

Travelling cables 51 run from the car 10 to the top of the shaft TS. The travelling cables 51 connect the control unit in the car 10 with a main control unit of the elevator.

The figure indicates also the pit floor PF, the first floor FF, the middle of the shaft MS and the top of the shaft TS.

FIG. 2 shows the working principle of a travelling cable support arrangement of an elevator according to the invention.

The ends of the travelling cables 51 may in a conventional way be fixedly attached so that a first end of the travelling cables 51 is fixedly attached in a lower fixing point F1 to the car frame 11 and a second opposite end of the travelling cables 51 is fixedly attached in an upper fixing point F2 positioned on the top of the shaft TS.

The travelling cable support arrangement of the elevator comprises a guide rail 110, an intermediate fixing point F3, and a movable travelling cable keeper 130.

The guide rail 110 may extend in a vertical direction from a pit floor PF to a middle MS of the elevator shaft 20. The guide rail 110 may be attached with brackets at a wall 21 of the elevator shaft 20.

The intermediate fixing point F3 may be positioned in connection with the guide rail 110. The intermediate fixing point F3 may be supported on an upper end of the guide rail 110 and thereby via the guide rail 110 on a wall 21 of the shaft 20. The intermediate fixing point F3 may on the other hand be supported directly on a wall 21 of the shaft 20 in the vicinity of the upper end of the guide rail 110. The intermediate fixing point F3 may be positioned in the middle MS of the shaft 20. The middle MS of the shaft 20 may be positioned halfway in the height direction of the shaft 20. This halfway may be positioned in the vertical direction in the middle between the first floor FF and the top of the shaft TS. The travelling cables 51 may be fixedly attached in said intermediate fixing point F3.

The travelling cable keeper 130 may be movably supported on the guide rail 110 so that the travelling cable keeper 130 is movable upwards and downwards along the guide rail 110. Each of the travelling cables 51 may be movably supported in support points S on the travelling cable keeper 130. The support points S may be arranged to form a curved path for the travelling cables 51. The travelling cables 51 are thus movable through the support points S.

FIG. 3 shows a side view of a travelling cable support arrangement of an elevator.

The figure shows the guide rail 110, the travelling cable keeper 130 and the travelling cables 51. The guide rail 110 may be supported by brackets 121 on a wall 21 of the elevator shaft 20.

The travelling cable keeper 130 may comprise a frame 140 and a support part 150.

The frame 140 may comprise five branches 141, 142, 143, 144, 145 having the shape of outwards protruding fingers. The branches 141, 142, 143, 144, 145 may extend outwards from a centre point C1 of the frame 140. The first branch 141 and the fifth branch 145 may extend in an opposite direction along a horizontal plane. The other branches 142, 143, 144 may extend downwards from the horizontal plane. The angle $\alpha 1$ between each of two adjacent branches 141, 142, 143, 144, 145 may be 45 degrees.

The support part 150 may extend vertically along the guide rail 110. An upper end of the support part 150 may be supported with first roller equipment 160 on the guide rail 110 and a lower end of the support part 150 may be supported with second roller equipment 170 on the guide rail 110. The travelling cable keeper 130 is thus movable upwards and downwards along the guide rail 110 with the roller equipment 160, 170 of the support part 150 of the travelling cable keeper 130. The construction of the first 160 and the second 170 roller equipment may be identical.

The frame may be attached to the support part 150 via the fifth branch 145 of the frame 150. An outer end of the fifth branch 145 of the frame 140 may be fixedly attached to the support part 150.

The frame 140 may further be supported with two support bars 147, 148 on the support part 150. A first support bar 147 may extend between the centre point C1 of the frame 140 and an upper end of the support part 150. A second support bar 148 may extend between the centre point C1 of the frame 140 and a lower end of the support part 150.

Each of the branches 141, 142, 143, 144, 145 in the frame 140 may be provided with three roller elements 146 positioned at a distance from each other. A passage is thus provided between the outer surfaces of a pair of two adjacent roller elements 146. A first travelling cable 51A may pass through the passages in all branches 141, 142, 143, 144, 145 in the frame 140 between a first pair of adjacent roller elements 146. A second travelling cable 51B may pass through the passages in all branches 141, 142, 143, 144, 145 in the frame 140 between a second pair of adjacent roller elements 146. The path of the first travelling cable 51A as well as the path of the second travelling cable 51B through the travelling cable keeper 130 may have a curved or looped shape. The path may have the shape of a half circle.

A support point S1, S2, S3, S4, S5 for the travelling cable 51A, 51B is thus formed between the roller elements 146 in each branch 141, 142, 143, 144, 145 of the frame 140.

FIG. 4 shows a frame of a travelling cable keeper for flat cables.

The frame 140 of the travelling cable keeper 130 consists of two identical frame parts 140A, 140B positioned at a distance from each other. The two frame parts 140A, 140B are connected to each other via the rolls 146 that are positioned between the two frame parts 140A, 140B. The shafts of the rolls 146 connect the two frame parts 140A, 140B together. A travelling cable keeper 130 for flat cables 51A, 51B may have roller elements 146 formed of rollers with a substantially cylindrical shape. A cylindrical outer surface of the rollers 146 is suitable for receiving a flat cable 51A, 51B.

FIG. 5 shows a frame of a travelling cable keeper for round cables.

The frame 140 of the travelling cable keeper 130 consists of two identical frame parts 140A, 140B positioned at a distance from each other. The two frame parts 140A, 140B are connected to each other via the roller elements 146 that are positioned between the two frame parts 140A, 140B. The shafts of the roller elements 146 connect the two frame parts 140A, 140B together. A travelling cable keeper 130 for round cables 51A, 51B may have roller elements 146 in the form of rollers with a substantially cylindrical shape with a groove on the outer surface of the rollers 146. The groove may be positioned on an axial middle portion of the rollers 146. The groove may have the shape of a half circle being suitable for receiving a round cable 51A, 51B.

FIG. 6 shows a support part of a travelling cable keeper.

The support part 150 may comprise a longitudinal body 151. The longitudinal body 151 may be provided with an end plate 152, 153 at each longitudinal end of the body 151. First roller equipment 160 may be attached to the upper end plate 152 and second roller equipment 170 may be attached to the lower end plate 153.

FIG. 7 shows roller equipment for the support part in the travelling cable keeper.

The guide rail 110 in this embodiment comprises a first branch 111, a second branch 112 parallel to the first branch 111, and a third branch 113 being perpendicular to the first branch 111 and the second branch 112 and connecting the middle points of the first branch 111 and the second branch 112. The cross section of the guide rail 110 may thus have substantially the shape of a letter I. The second branch 112 of the guide rail 110 may be attached with brackets to a wall 21 in the shaft 20. The roller equipment 160 may thus be supported on the first branch 111 of the guide rail 110.

The roller equipment 160 in this embodiment comprises six rollers 161, 162, 163, 164, 165, 166 acting on the first branch 111 of the guide rail 110.

The six rollers 161, 162, 163, 164, 165, 166 are grouped into a first pair of rollers 161, 162, a second pair of rollers 163, 164 and a third pair of rollers 165, 166. The rollers 161, 162 in the first pair of rollers 161, 162 and the rollers 163, 164 in the second pair of rollers 163, 164 act on opposite surfaces of the first branch 111 of the guide rail 110. The rotational shaft of these four rollers 161, 162, 163, 164 may extend in a first horizontal direction. The rollers 165, 166 in the third pair of rollers 165, 166 act on opposite vertical side edges of the first branch 111 of the guide rail 110. The rotational shaft of the rollers 165, 166 in the third pair of rollers 165, 166 may extend in a second horizontal direction, said second horizontal direction being perpendicular to the first horizontal direction.

The two rollers 162, 164 acting on an outside surface of the first branch 111 of the guide rail 110 may be supported on a common shaft. The outer ends of the common shaft may be supported on spring means 162A, 164A. The spring means 162A, 164A press the two rollers 162, 164 with a certain force against the outside surface of the first branch 111 of the guide rail 110. The shafts of the two rollers 165, 166 acting on the opposite vertical side edges of the first branch 111 of the guide rail 110 may also be supported on spring means 165A, 166A. Each roller 165, 166 is thus pressed with a respective spring means 165A, 166A with a certain force against the respective vertical side edge of the first branch 111 of the guide rail 110.

The roller equipment 160, 170 at the opposite longitudinal ends of the support part 150 may be identical.

The figures show an embodiment in which roller elements 146 in the form of substantially cylindrical rollers are used in the support points S1, S2. S3. S4, S5 in the travelling cable keeper 130. This is an advantageous embodiment especially in case the speed of the elevator car 10 is over 4 m/s. In case the speed of the elevator car 10 is smaller than 4 m/s, then gliding elements may be used in the support points S1, S2, S3, S4, S5 for the travelling cables 51 in the travelling cable keeper 130.

The figures show an embodiment in which two travelling cables 51A, 51B are supported on the travelling cable keeper 130. The travelling cable keeper 130 could naturally support any number of travelling cables 51A, 51B e.g. 1, 2, 3, 4, 5 etc. The travelling cable keeper 130 could thus support at least one travelling cable 51 or at least two travelling cables 51A, 51B etc.

The total weight of a travelling cable keeper 130 according to the invention may be in the order of 60 kg.

The speed Vt of the travelling cable keeper 130 along the guide rail 110 is half of the speed V of the elevator car 10 i.e. $Vt=V/2$.

The rotational speed of the rollers 146 in the travelling cable keeper 130 is $RPM=(60*1000*Vt)/(D*\pi)$. If the speed of the car is 6 m/s and the diameter of the rollers 146 is 80 mm, then $RPM=(60*1000*6)/(2*80*\pi)=716$ r/min.

The travelling distance of the travelling cable keeper 130 is half of the car 10 running distance.

When the car 10 is moving upwards, the travelling cables 51 pass through the travelling cable keeper 130 by rolling of the rollers 146 and the travelling cable keeper 130 is also carried upwards along the guide rail 110.

When the car 10 is moving downwards, the travelling cable keeper 130 will be rolling down along the guide rail 110, whereby it also draws the travelling cables 51 downwards.

The travelling cables 51 are in both cases tensioned and kept in position by the travelling cable keeper 130 at the travelling cable 51 loop end, and the free length of the travelling cables 51 is changed as the car 10 moves up and down.

The swaying of the traveling cables 51 can be greatly reduced with the travelling cable keeper 130 according to the invention due to the "movable fixing point" formed by the travelling cable keeper 130 and the "tension weight" formed by the travelling cable keeper 130. Twisting of the travelling cables 51 is also reduced as the travelling cables 51 are kept in their natural loops and the travelling cable keeper 130 is aligned with the guide rail 110.

The figures show an embodiment in which the frame 140 of the travelling cable keeper 130 comprises five branches 141, 142, 143, 144, 145. This in an advantageous embodiment in order to form a smooth curved path for the travelling cable 15. The number of branches 141, 142, 143, 144, 145 is, however, by no means limited to five. There could be any number of branches e.g. one, two, three, four, at least one, at least two, at least three, at least four etc. branches 141, 142, 143, 144, 145 in the frame 140 of the travelling cable keeper 130.

The guide rail 110 is in the figures intended to be used only for the travelling cable keeper 130. This is an advantageous embodiment and makes it possible to adapt the cross section of the guide rail 110 especially for this purpose. The guide rail 110 would in such case extend from the pit floor PF to a middle point MS of the shaft 20. Another possibility would be to use one of the guide rails 25 of the car 10 also as a guide rail for the travelling cable keeper 130. The roller equipment 160, 170 would then have to be adapted for the cross section of the car guide rail 25. The guide rail 25 would in such case extend from the pit floor PF at least to a middle point MS of the shaft 20 and preferably to the top TS of the shaft 20.

The invention is not limited to the elevator disclosed in the figures. The invention can be used in any type of elevator e.g. also in elevators lacking a machine room and/or a counterweight. The counterweight is in the figures positioned on the back wall of the elevator shaft. The counterweight could be positioned on either side wall of the shaft or on both side walls of the elevator shaft. The lifting machinery may be positioned in the shaft or in a machine room at the top of the shaft. The lifting machinery could be positioned within the shaft at the bottom or at the top or at some point between the top and the bottom of the shaft.

The invention may be used in connection with installations of an elevator in a new building and in connection with renovations of an existing elevator. The invention may be used in all kind of elevators. The invention is, however, especially useful in high rise elevators, in marine elevators and in elevators used in seismic areas. This is due to the fact that swaying of the travelling cables may be a real problem in high rise elevators, in marine elevators and in elevators used in seismic areas.

It will be obvious to a person skilled in the art that, as the technology advances, the inventive concept can be implemented in various ways. The invention and its embodiments are not limited to the examples described above but may vary within the scope of the claims.

The invention claimed is:

1. A travelling cable support arrangement of an elevator comprising:

at least one travelling cable, a guide rail extending from a pit floor at least to a middle of an elevator shaft, an intermediate fixing point positioned in connection with the guide rail, the at least one travelling cable being fixedly attached in said intermediate fixing point, a travelling cable keeper being movably supported on the guide rail so that the travelling cable keeper is movable upwards and downwards along the guide rail, the travelling cable keeper including a frame having a plurality of support points positioned a distance from each other in a radial direction, each of the plurality of support points including plural rollers such that the at least one travelling cable is movably supported at each of the plurality of support points by the plural rollers at opposite surfaces of the traveling cable with a path of the at least one travelling cable through the support points in the travelling cable keeper being curved.

2. The arrangement according to claim 1, wherein the intermediate fixing point is positioned in the middle of the elevator shaft in a height direction of the shaft.

3. The arrangement according to claim 1, wherein at least two travelling cables are movably supported in support points on the travelling cable keeper.

4. The arrangement according to claim 1, wherein the travelling cable keeper further comprises a support part being movably supported on the guide rail.

5. The arrangement according to claim 4, wherein the support part comprises a longitudinal body extending along the guide rail, and roller equipment being provided on both longitudinal ends of the body.

6. The arrangement according to claim 5, wherein a cross section of the guide rail comprises a first branch and a second branch parallel to the first branch and a third branch being perpendicular to the first branch and the second branch and connecting the middle points of the first branch and the second branch.

7. The arrangement according to claim 6, wherein the roller equipment comprises:

a first pair of rollers, a second pair of rollers acting on an opposite surface of the first branch of the guide rail, and a third pair of rollers acting on opposite ends of the first branch of the guide rail.

8. The arrangement according to claim 7, wherein one roller of the first pair of rollers and one roller of the second pair of rollers is flexibly supported with spring means.

9. The arrangement according to claim 7, wherein both rollers of the third pair of rollers are flexibly supported with spring means.

10. The arrangement according to claim 1, wherein the frame is formed of two frame halves, the support points being formed between the plural rollers extending between the two frame halves.

11. The arrangement according to claim 1, wherein the frame comprises branches having the shape of fingers protruding outwards from a centre point.

12. The arrangement according to claim 1, wherein the frame comprises five branches extending outwards from a centre point, the first branch and the fifth branch extending in a horizontal plane in opposite directions, the rest of the branches extending downwards from the centre point positioned on the horizontal plane, an angle between each of two adjacent branches being 45 degrees.

13. The arrangement according to claim 1, wherein the guide rail is a separate guide rail mounted only for the travelling cable keeper.

14. An elevator comprising:

the travelling cable support arrangement according to claim 1;

a car configured to move upwards and downwards in a shaft; and the at least one travelling cable passing from the car to a top of the shaft.

15. The arrangement according to claim 1, wherein the frame comprises five branches extending outwards from a centre point.

16. The arrangement according to claim 15, an angle between each of two adjacent branches is 45 degrees.

17. The arrangement according to claim 15, each of the branches defines one of the plurality of support points with each including plural rollers that support respective sides of the traveling cable.

18. A method for supporting travelling cables of an elevator, the method comprising:

providing at least one travelling cable to be supported in a travelling cable support arrangement, providing a guide rail extending from a pit floor at least to a middle of an elevator shaft, providing an intermediate fixing point positioned in connection with the guide rail, attaching the travelling cables fixedly in said intermediate fixing point, supporting a travelling cable keeper movably on the guide rail so that the travelling cable keeper is movable upwards and downwards along the guide rail, the travelling cable keeper including a frame having a plurality of support points positioned a distance from each other in a radial direction, each of the plurality of support points including plural rollers such that the at least one travelling cable is movably supported at each of the plurality of support points by the plural rollers at opposite surfaces of the traveling cable with a path of the at least one travelling cable through the support points in the travelling cable keeper being curved.

* * * * *